United States Patent [19]

Christianson

[11] Patent Number: 4,872,453

[45] Date of Patent: Oct. 10, 1989

[54] SNORKEL

[76] Inventor: Tony Christianson, 277 Grulla Ct., Norco, Calif. 91760

[21] Appl. No.: 292,224

[22] Filed: Dec. 30, 1988

[51] Int. Cl.[4] ..... B63C 11/16

[52] U.S. Cl. ..... 128/201.11; 272/DIG. 1

[58] Field of Search ..... 128/201.11, 201.27, 128/201.28, 205.24, 205.25; 137/41; 272/1 B, DIG. 1; 273/1 L

[56] References Cited

U.S. PATENT DOCUMENTS

| | | | |
|---|---|---|---|
| 2,317,236 | 4/1943 | Wilen et al. | 128/201.11 |
| 2,362,775 | 11/1944 | Sebouh | 128/201.11 |
| 2,408,166 | 9/1946 | Hawkins | 128/201.11 |
| 2,931,057 | 4/1960 | Vilarem | 128/201.11 |
| 4,071,024 | 1/1978 | Blanc et al. | 128/201.11 |
| 4,278,080 | 7/1981 | Schuch | 128/201.11 |
| 4,610,246 | 3/1985 | Delphia | 128/201.11 |
| 4,708,135 | 11/1987 | Arkema | 128/201.11 |
| 4,793,341 | 12/1988 | Arasmith | 128/201.11 |
| 4,805,610 | 2/1989 | Hunt | 128/201.11 |

*Primary Examiner*—E. N. Eickholt

[57] ABSTRACT

The present invention is an improved skin diving snorkel having a conduit with an unobstructed, open end above water and an underwater end which has an upward opening mouthpiece. The mouthpiece provides a flow path from the conduit to the interior of the diver's mouth. A purge valve, situated adjacent and below the mouthpiece, allows water in the snorkel to flow to ambient when hydrostatic pressure within the snorkel is greater than ambient. A chamber, intersecting the conduit at approximately mid-length, houses a float member. When the snorkel is filled with water the float member is buoyed into the conduit and blocks upward flow therein.

The flooded snorkel is purged by exhaling into the mouthpiece. Because the float member blocks upward flow when the conduit is flooded, the upwardly expanding exhaled air is trapped beneath the float member. The trapped air displaces the water in the conduit, forcing the water down and out the purge valve. Exhalation pressure holds the buoyant member in the blocking position until the purging exhalation is complete. Release of exhalation pressure at the start of inhalation allows the buoyant member to drop back into the chamber, clearing the conduit for unrestricted respiration.

17 Claims, 8 Drawing Sheets

SNORKEL

BACKGROUND OF THE INVENTION

1. Field of the Invention

The present invention is generally related to snorkels used by skin divers. More particularly, this invention is related to devices for purging water from a flooded snorkel.

2. Description of the Prior Art

Skin divers use the snorkel as a means to breathe while swimming face down on the water surface. The snorkel functions as a conduit between the diver's mouth and the overhead air. Typically, when in use, the open end of the snorkel conduit extends a short distance above the water surface. Occasionally, due to swimming movements or wave action, small amounts of water will flow into the open end of the snorkel and partially flood the conduit. Also, water will flood the snorkel when the diver swims or dives below the water surface. An experienced skin diver can sense when water enters the snorkel and responds by immediately stopping inhalation. Respiration is resumed after the snorkel has been purged of water.

Inexperienced skin divers find occasional flooding especially troublesome because, undetected, water can be inhaled resulting in coughing and extreme discomfort. Consequently, several designs have been proposed to restrict or block the normally open end of the snorkel and thereby prevent water from entering.

U.S. Pat. No. 4,071,024 entitled Snorkel, issued to Max A. Blanc on Jan. 31, 1978, teaches an air entrapping cap which is mounted on the above water opening of the snorkel. A tortuous passage in the cap retards water flow into the snorkel. Although such a cap is somewhat effective in blocking the occasional flow of surface water into the snorkel, it also retards expulsion of water which enters the snorkel during a dive or swim below the water surface. The significant increase in respiratory and purging effort limits its utility and subsequent popularity.

U.S. Pat. No. 2,317,236 entitled Breathing Apparatus for Swimmers, issued to C. H. Wilen, et al, on Apr. 20, 1943, teaches a valve with a buoyant ball arranged to block the above water end of the snorkel whenever water starts to enter. Such valves are bulky, often fail to seal and, also, significantly increase respiratory effort. Although once popular, such devices are not considered unreliable and obsolete.

The open snorkel conduit will be completely flooded with water when a skin diver returns to the surface after swimming or diving underwater. The open end of the snorkel is above the water surface when the skin diver assumes the face down, surface swimming attitude. With the open end of the snorkel above the water surface, the conduit is purged for respiration by exhaling an explosive blast of air into the mouthpiece.

Surface tension forms the purging blast of air into a bubble which spans the cross section of the conduit. Pressure within the bubble expands the bubble toward the open end of the snorkel conduit. As the leading surface of the bubble moves away from the mouthpiece, the bulk of the water within the conduit is pushed ahead of the bubble and out the open end.

The purging bubble of air will slip past water which adheres to the inner surface of the conduit. After the purging air bubble is spent, residual water will flow down the inner surface toward the mouthpiece. Also, water which splashes into the open end of the snorkel conduit due to swimming movements or wave action will typically strike and adhere to the inner surface of the conduit and thereafter flow toward the mouthpiece. Water accumulates at the lowermost portion of the snorkel conduit, typically adjacent the mouthpiece, and obstructs the conduit. Unless the conduit is completely blocked, a slow and cautious inhalation is possible after which another purging exhalation can be made.

The respiratory effort needed to purge a snorkel is significant. Many skin divers lack the respiratory strength needed to completely purge the snorkel with a single exhalation, and must repeat the purging procedure several times. Also, water will sometimes enter the snorkel just as the diver has completed an exhalation, leaving very little air in the lungs to satisfactorily complete a purge. Consequently, a means which decreases the respiratory effort and the amount of air required to purge a snorkel will be very beneficial.

A popular solution places an externally directed purge valve in the wall of the snorkel conduit at a location near the snorkel mouthpiece. Water in the flooded conduit which extends above the ambient water surface will drain through the purge valve. Because the total volume of water in the flooded snorkel is reduced by water flow through the purge valve, the respiratory effort required to purge the remaining water is also reduced.

Unfortunately, a purge valve also provides an alternate path for forcefully exhaled air. A purge valve located close to the mouthpiece will quickly and wastefully dissipate the explosive blast of purging air. One solution to this problem places the purge valve at a location approximately midway between the mouth opening and the open end of the snorkel conduit.

At mid-length of the snorkel conduit, the purge valve will be close to the ambient water surface when the skin diver is swimming face down on the water surface. At such a location, the purge valve will drain that portion of the snorkel conduit which extends above the water surface, but will not initially interfere with the purging blast of air. Even at this location, the purge valve will dissipate the forcefully exhaled air and the amount of residual water adhering to the inner surface of the conduit between the purge valve and the open end will be substantial. The residual water subsequently accumulates at the lowermost portion of the snorkel conduit and obstructs the conduit. Consequently, the purge valve by itself, even when located mid-length of the snorkel conduit, is of limited benefit.

U.S. Pat. No. 4,278,080 entitled Diving Snorkel, issued to Joseph N. Schuch on July 14,1981, teaches a purge valve located at the bottom of a branch conduit which joins the snorkel conduit at a location approximately midway between the mouthpiece and the open end. The purge valve drains the snorkel conduit until the water level within the conduit matches the ambient water level. Part of the purging air will divert into the branch conduit and force water within the branch conduit out the purge valve. Schuch teaches that the branch conduit must have sufficient length to provide the transient resistance necessary to allow purging of the snorkel conduit before the purging air reaches and is dissipated by the purge valve.

Water within the snorkel conduit of Schuch is pushed out the open end before the purging air clears the branch conduit of water and reaches the purge valve.

Nevertheless, diverting part of the purging bubble of air into a branch conduit abates the driving pressure within the purging bubble and allows significant residual water to adhere to the upper portion of the snorkel conduit. Consequently, although the snorkel configuration of Schuch somewhat reduces the effort required to purge a flooded snorkel, it does not decrease the amount of purging air required, and it does not reduce residual water which adheres to the snorkel conduit wall and soon flows down the wall to obstruct the snorkel conduit near the mouthpiece. Also, the branch conduit adds significantly to the size of the snorkel, making the snorkel unwieldy in use.

In view of the foregoing factors, conditions and problems which are characteristic of the prior art, and improved skin diving snorkel is needed. Water should purge from the improved snorkel with a minimum of respiratory effort and without a wasteful loss of purging air. Also, small amounts of water which accumulate inside the improved snorkel after splashing in the open end, and water remaining after a purging exhalation, should not obstruct the airway. The improved snorkel should be compact and easy to use. The present invention satisfies all of these requirements.

SUMMARY OF THE INVENTION

The present invention is an improved skin diving snorkel having a conduit with an unobstructed, open end above water and an underwater end which has an upward opening mouthpiece. The mouthpiece provides a flow path from the conduit to the interior of the diver's mouth. A purge valve, situated adjacent and below the mouthpiece, allow water in the snorkel to flow to ambient when hydrostatic pressure within the snorkel is greater than ambient. A small chamber, intersecting the conduit at approximately mid-length, houses a float member. When the snorkel is filled with water the float member is buoyed from the chamber into the conduit and blocks upward flow therein. The flooded snorkel is purged by exhaling into the mouthpiece. Because the float member blocks upward flow when the conduit is flooded, the upwardly expanding exhaled air is trapped beneath the float member. The trapped air displaces the water in the conduit, forcing the water down and out the purge valve. Exhalation pressure holds the buoyant member in the blocking position until the purging exhalation is complete. Release of exhalation pressure at the start of inhalation allows the buoyant member to drop back into the chamber, clearing the conduit for unrestricted respiration.

DESCRIPTION OF THE DRAWINGS

A detailed description of the invention is made with reference to the accompanying drawings wherein like numerals designate corresponding parts in the several Figures.

DESCRIPTION OF THE PREFERRED EMBODIMENT

The following detailed description is of the best presently contemplated modes of carrying out the invention. This description is not to be taken in a limiting sense, but is made merely for purposes of illustrating the general principles of the invention.

Figure 1:
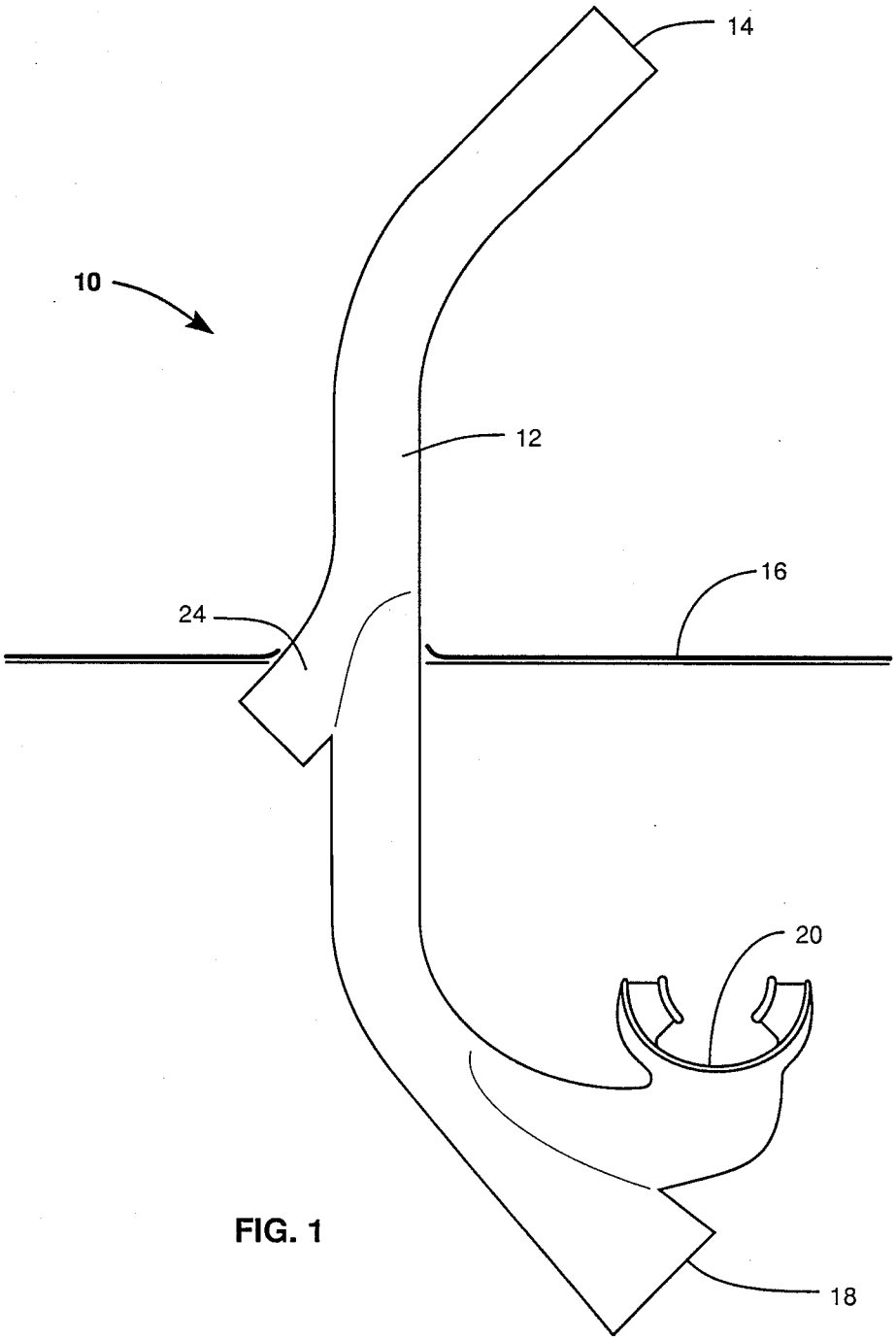
FIG. 1 is a front elevation view of a snorkel which has been constructed in accordance with the principles of the present invention, and which is pictured in the approximate position of use by a skin diver swimming face down on the water surface.
Figures 2, 3:
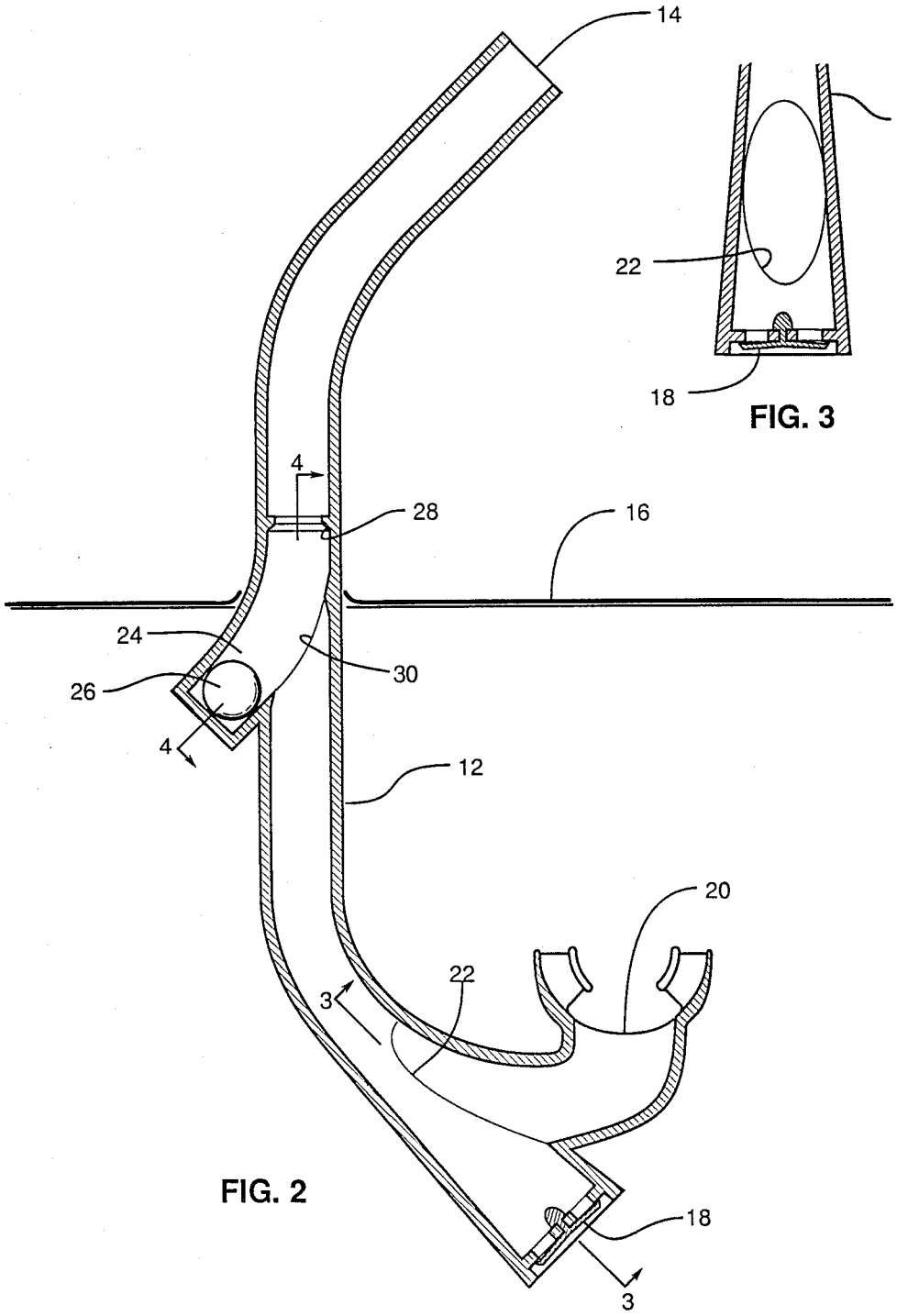
FIG. 2 is a longitudinal sectional view of the snorkel of FIG. 1, shown during respiration.
FIG. 3 is a partial sectional view of the snorkel, taken along a plane corresponding to line 3—3 of FIG. 2.

Referring to FIGS. 1 and 2, improved snorkel 10 is pictured in the approximate position of use by a skin diver swimming face down on the water surface. (For clarity, the diver is not pictured in the FIGS.) Snorkel 10 includes conduit 12 having an upper end with opening 14. The upper end of conduit 12 extends into the air above ambient water surface 16. Air and water can freely enter and exit conduit 12 because opening 14 is unobstructed and provides fluid flow there thru with little or no resistance. The lower end of conduit 12 is closed by purge valve 18.

Purge valve 18 is oriented to allow water to flow from conduit 12 to ambient. Purge valve 18 is, typically, a flexible diaphragm of a resilient material, for example silicon elastomer or the like, which is restrained in such a way that it can selectively flex under slight pressure to allow flow in one direction only. Reverse pressure forces the diaphragm to seal closed. Consequently, purge valve 18 will prevent the reverse flow of ambient water into conduit 12.

Upward opening mouthpiece 20, adjacent and above purge valve 18, branches from the side of conduit 12. Mouthpiece 20 is adapted to be held by the mouth of the diver and provides a flow path from conduit 12 to the interior of the mouth. (In the FIGS., the opening of mouthpiece 20 should be considered covered by the diver's mouth.) The intersection of mouthpiece 20 will conduit 12 forms an approximately elliptical opening 22 (as shown best in FIG. 3).

Conduit 12 is configured to approximately match the curvature of the diver's head. The upper portion of conduit 12 curves smoothly to place opening 14 approximately over the center of the head. Alternately, the upper portion of conduit 12 can be straight.

Respiration and purging are facilitated by providing a substantially smooth flow path which is free of abrupt changes in path direction. While not so limited, the curvature may, for example, follow an elliptical path.

Chamber 24 intersects conduit 12 at approximately mid-length. The upper portion of chamber 24 is in the respiratory flow path of conduit 12. The lower portion of chamber 24 branches from the side of conduit 12. Mobile member 26 is loosely restrained and moves freely within the confines of chamber 24.

The intersection of conduit 12 and chamber 24 defines seat 28 at the the top of chamber 24. Seat 28 is adapted to form a substantially air tight closure with mobile member 26. Consequently, when mobile member 26 rests against seat 28, upward fluid flow in conduit 12 is blocked.

Figures 4, 5:
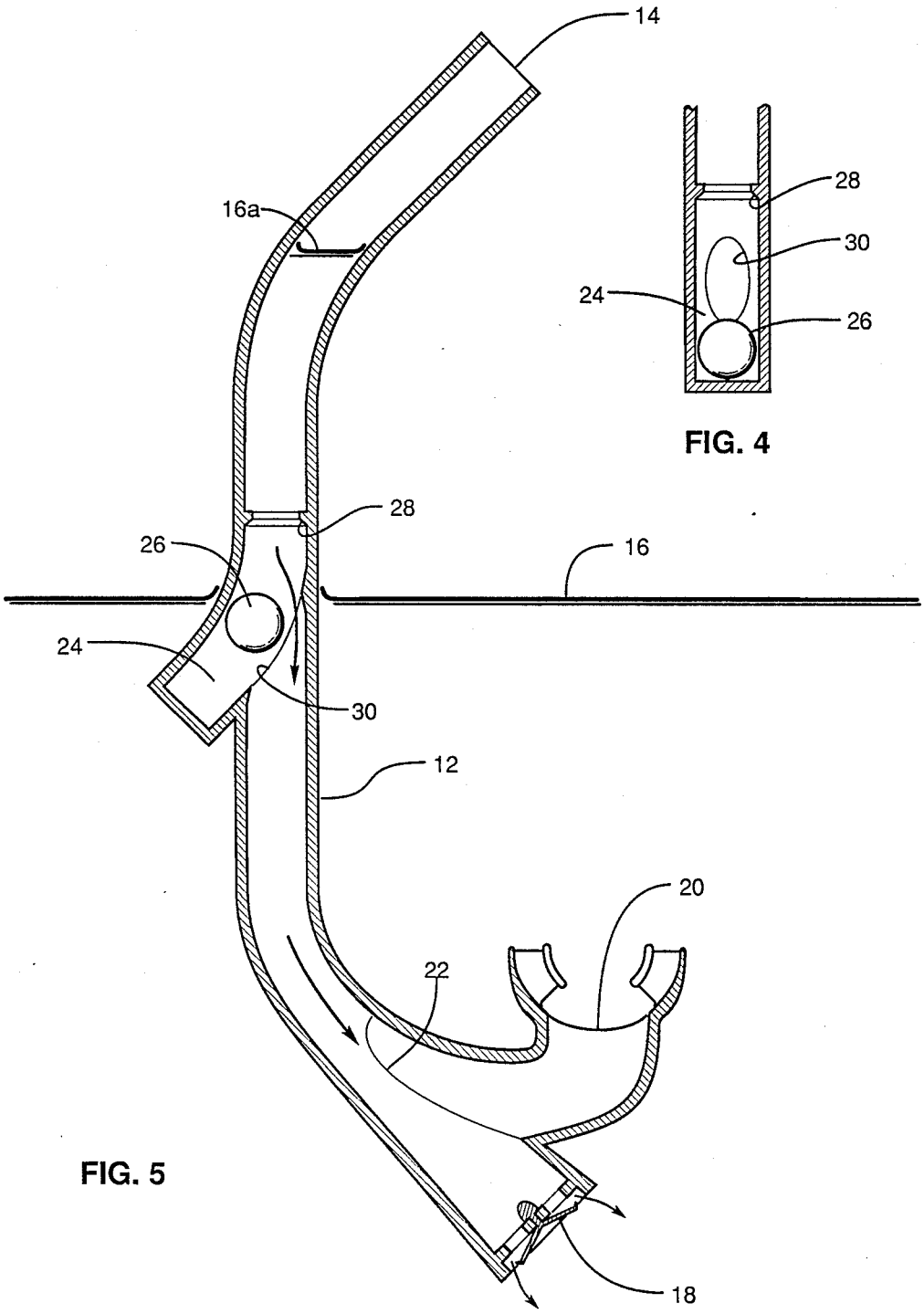
FIG. 4 is a partial sectional view of the snorkel, taken along a curved surface corresponding to line 4—4 of FIG. 2.
FIG. 5 is a view similar to FIG. 2, showing the snorkel flooded with that portion above the water surface draining to ambient.

In addition, the intersection of conduit 12 and chamber 24 defines an approximately elliptical opening 30 in the side of chamber 24 (as shown best in FIG. 4). By sizing opening 30 smaller in width than mobile member 26, mobile member 26 will be unable to drop through opening 30 into the lower part of conduit 12. Alternately, a bar or the like transverse opening 30 will prevent mobile member 26 from dropping into the lower part of conduit 12. Similarly, mobile member 26 is unable to move past seat 28 into the upper part of conduit 12.

Mobile member 26 has a specific gravity which provides buoyancy in water. Mobile member 26 has structural strength sufficient to resist compressive loading due to ambient water pressure at depths likely to be encountered by a diver.

Although other shapes may be utilized, mobile member 26 is spherical in the preferred embodiment. Correspondingly, in the preferred embodiment seat 28 is a conical shelf or the like sized to nest spherical mobile member 26 such that a substantially airtight closure is achieved when mobile member 26 rests against it.

Figure 6:
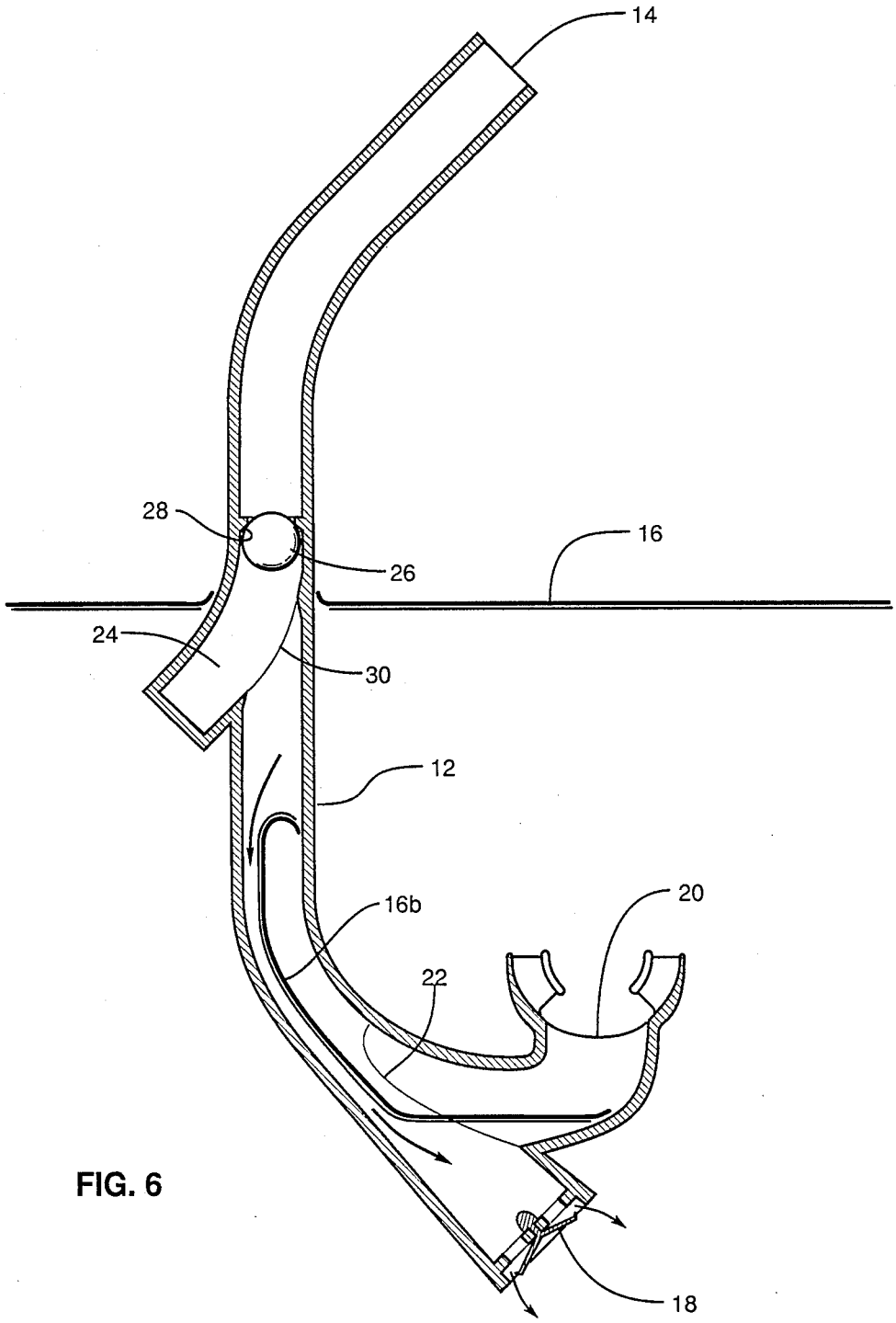
FIG. 6 is a view similar to FIG. 2, showing the snorkel during a purging exhalation.

During respiration, conduit 12 and chamber 24 are free of water and the force of gravity holds mobile member 26 at the bottom of chamber 24, out of the respiratory flow path of conduit 12. Referring to FIGS. 5 and 6, when chamber 24 fills with water, mobile member 26 is buoyed upward against seat 28, thereby blocking upward flow in conduit 12.

When a skin diver swims or dives below the water surface, water will pour into conduit 12 through opening 14, completely flooding the snorkel. As a consequence of flooding, mobile member 26 is buoyed upward against seat 28. After the skin diver surfaces and assumes the face down, surface swimming attitude, hydrostatic pressure will cause water (depicted as having surface 16*a* in FIG. 5) within the upper portion of snorkel 10 to flow downward (depicted as arrows in FIG. 5) past mobile member 26 and through purge valve 18. Referring to FIG. 5, the force of the downward flow of water has pushed mobile member 26 away from seat 28, and the outflow of water has flexed purge valve 18 outward.

The downward flow of water past mobile member 26 is facilitated because the clearance around mobile member 26 in chamber 24 provides a flow area at least equal to the flow area provided by the cross section of conduit 12. Similarly, the outflow of water through purge valve 18 is facilitated when the purge valve has a flow area at least equal to the flow area of conduit 12.

After surface 16*a* drops to the level of ambient surface 16, water remaining in conduit 12 is purged by exhaling air into mouthpiece 20. Surface tension forms the exhaled air into bubble 16*b* which expands into conduit 12. As the leading surface of the bubble moves away from mouthpiece 20, the bulk of water within conduit 12 is pushed ahead of the bubble and lifted toward opening 14.

Referring to FIG. 6, a purging exhalation has lifted the water in conduit 12 and chamber 24 until mobile member 26 blocked continued upward flow. Because upward flow is blocked, the upwardly expanding exhaled air moves through the water in conduit 12 and accumulates below mobile member 26. The accumulating air displaces the water in conduit 12, forcing the water down and out purge valve 18. When surface 16*a* drops away from mobile member 26, the buoyant force holding it against seat 28 is removed, but exhalation pressure maintains mobile member 26 against seat 28 until the purging exhalation is complete. Release of exhalation pressure at the start of inhalation allows mobile member 26 to drop to the bottom of chamber 24, clearing conduit 12 for unobstructed respiration.

Figures 7, 8:
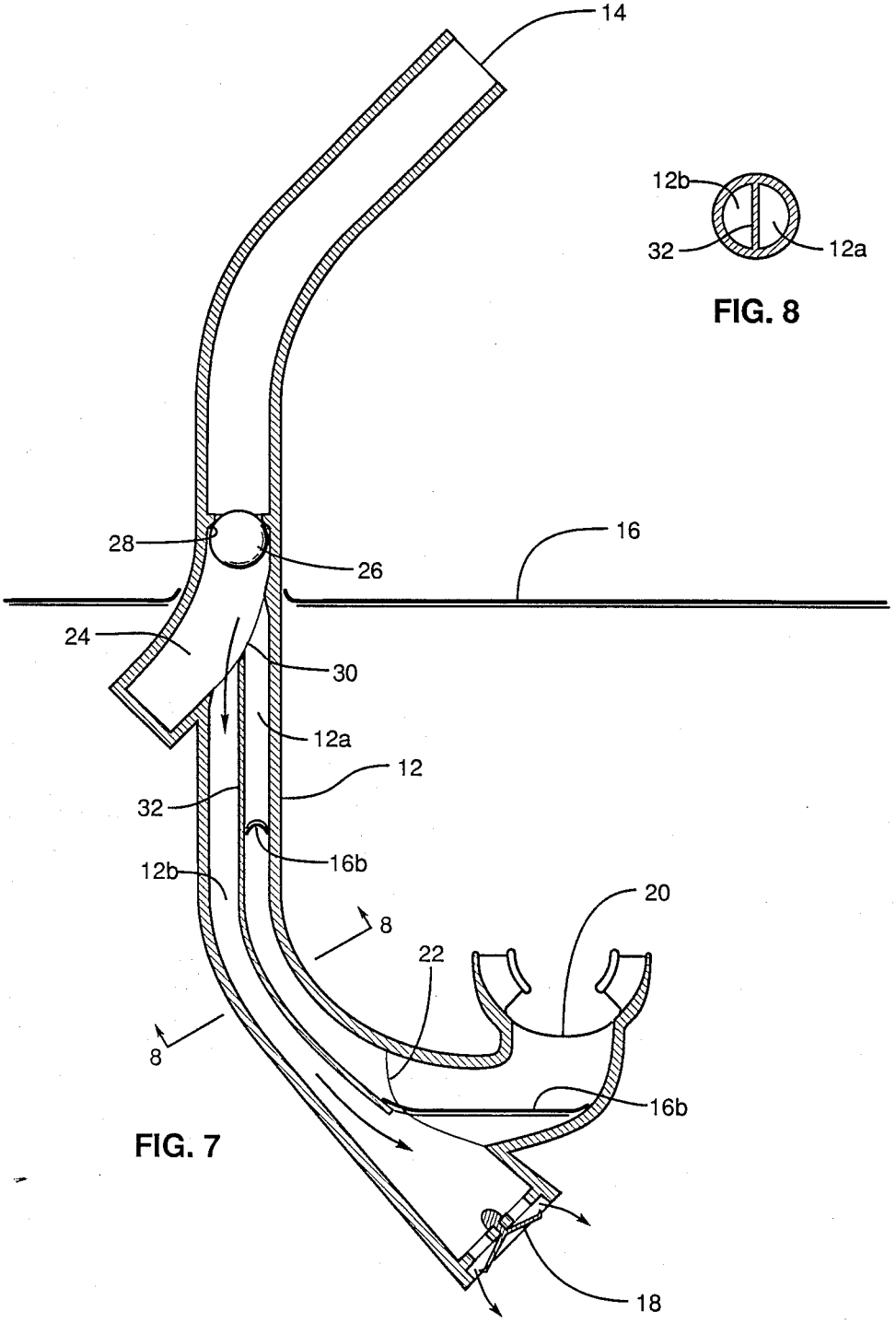
FIG. 7 is a view similar to FIG.6, showing an alternate internal configuration.
FIG. 8 is a sectional view of the snorkel of FIG. 7, taken along a plane corresponding to line 8—8.

The upward movement of expanding exhaled air in flooded conduit 12 can impede downward movement of water to purge valve 18. The purging process can be quickened by dividing conduit 12 into two parallel channels, one for the ascending air, the other for the descending water. Referring to FIGS. 7 and 8, there is shown an alternate internal configuration incorporating wall 32 which tranverses the cross section of conduit 12. Wall 32 runs the length of conduit 12 between openings 22 and 30 thereby partitioning conduit 12 into parallel channels 12*a* and 12*b*. Because channel 12*a* is closest to mouthpiece 20, exhaled air will tend to expand first into channel 12*a*. Water displaced by air ascending in channel 12*a* will flow down channel 12*b*. Water descending in channel 12*b* is not impeded by the ascending air in channel 12*a*, consequently the water in conduit 12 will be rapidly displaced and flow out purge valve 18.

Providing conduit 12 with an elliptical cross section will serve to quicken the purging process without need of wall 32. With an elliptical cross section, ascending air will tend to maintain a circular cross section which travels up the center of the conduit, allowing water to flow down the rest of the elliptical cross section unimpeded.

Figure 9:
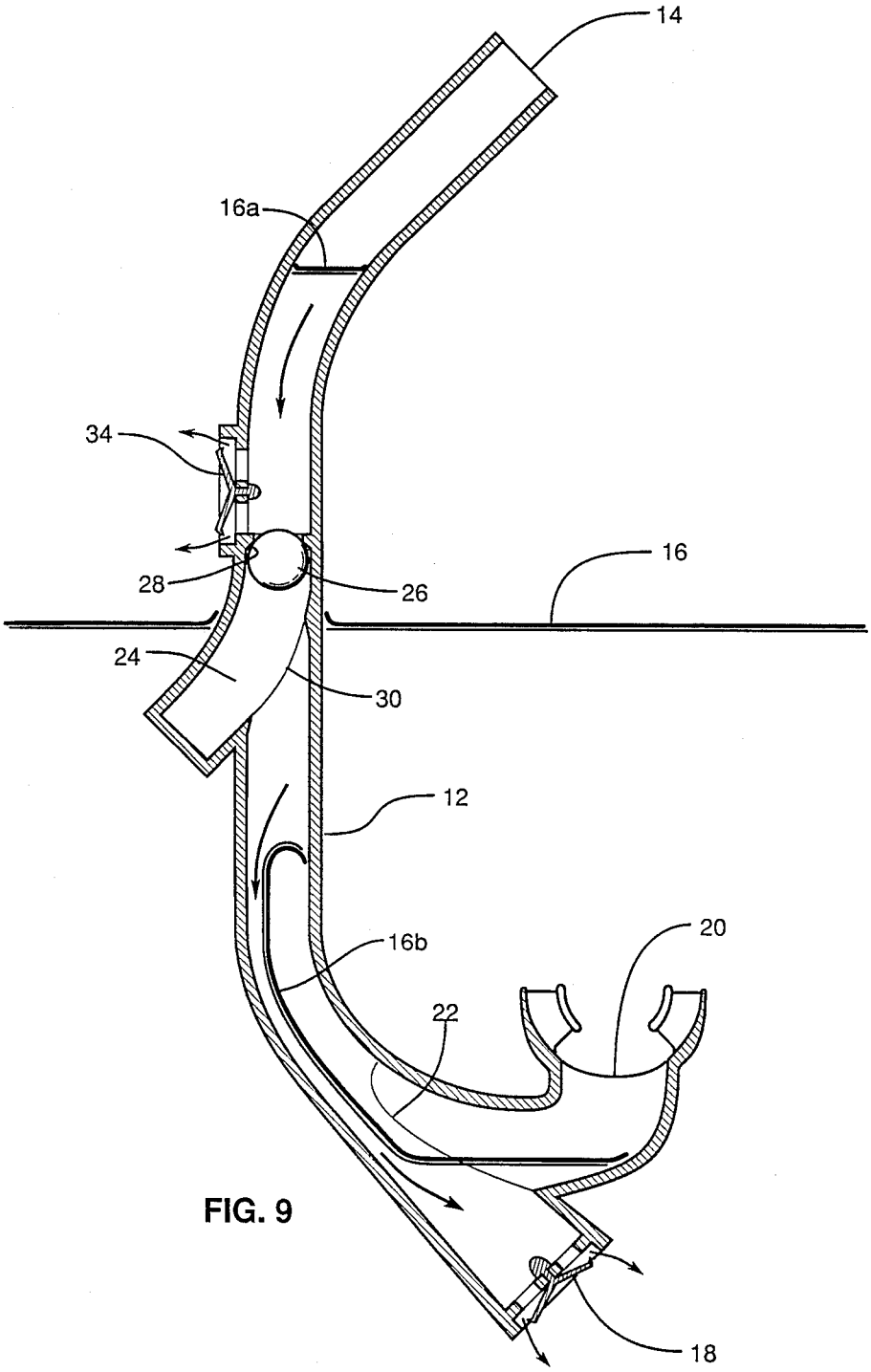
FIG. 9 is a longitudinal sectional view of an alternate snorkel configuration which has been constructed in accordance with the principles of the present invention, shown during a purging exhalation.

Referring to FIG. 9, there is shown an alternate snorkel configuration, constructed in accordance with the principles of the present invention, which incorporates second purge valve 34 above seat 28. Rapid drainage of the upper portion of conduit 12 is facilitated by the addition of second purge valve 34. As depicted in FIG. 9, the upper portion of conduit 12 is drained by purge valve 34 even when mobile member 26 blocks flow due to the pressure of a simultaneously occurring purging exhalation.

Figure 10:
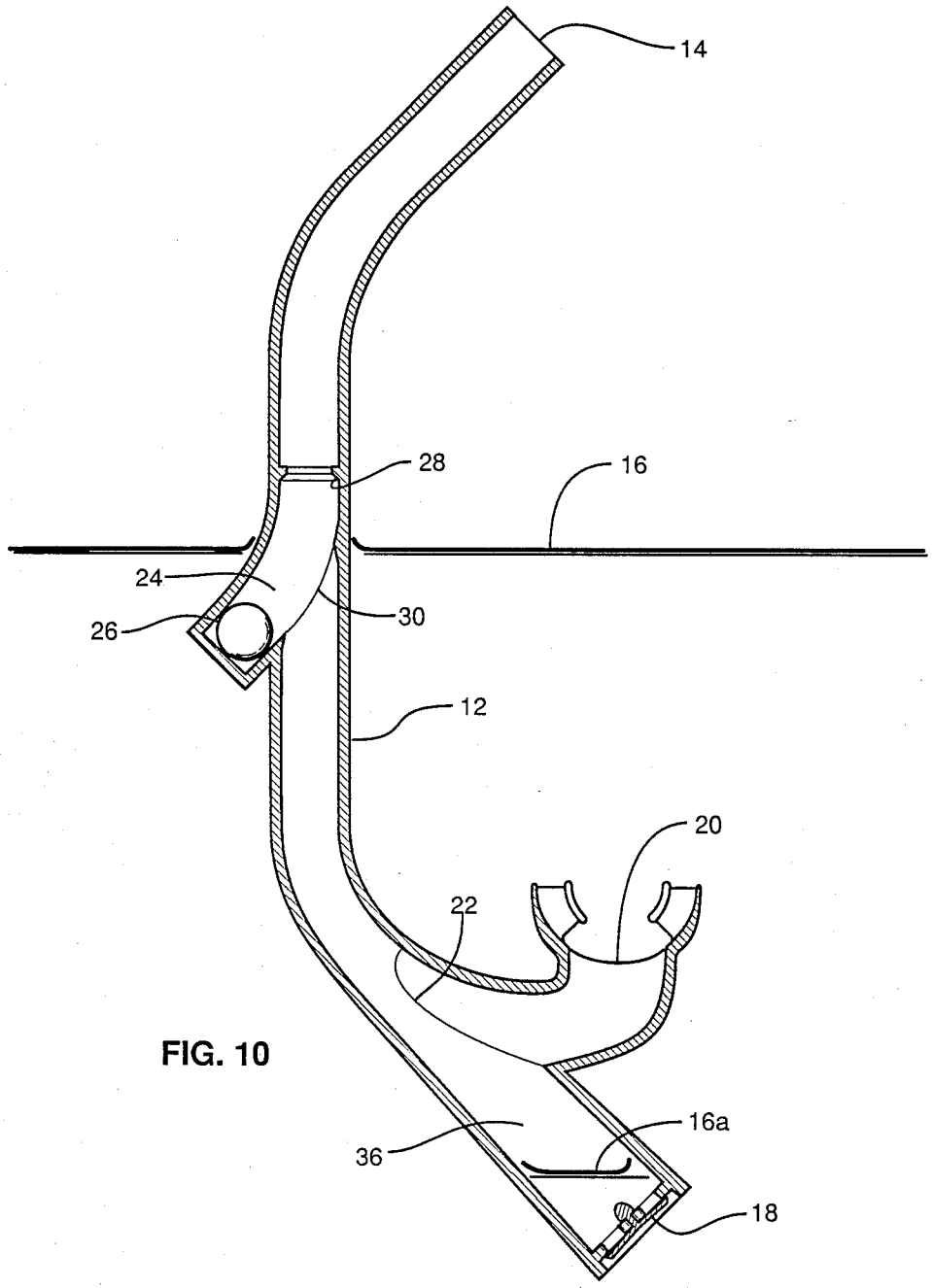
FIG. 10 is a longitudinal sectional view of another alternate snorkel configuration which has been constructed in accordance with the principles of the present invention, shown during respiration.

Water which splashes into opening 14, due to swimming movements or wave action or the like, will accumulate in conduit 12 above purge valve 18. Similarly, fluids from the mouth, and residual water which adheres to the inner surface of conduit 12 after a purging exhalation, will accumulate above purge valve 18. Referring to FIG. 10, there is shown an alternate snorkel configuration, constructed in accordance with the principles of the present invention, which incorporates chamber 36 directly above purge valve 18. Chamber 36 is an extension of conduit 12 and is advantageously sized to hold residual water which remains after a purging exhalation and also small amounts of water which occasionally splash into opening 14. Empirical studies have determined that a chamber volume equivalent to ten percent (10%) of the snorkel's total internal volume is sufficient for this purpose.

Figure 11:
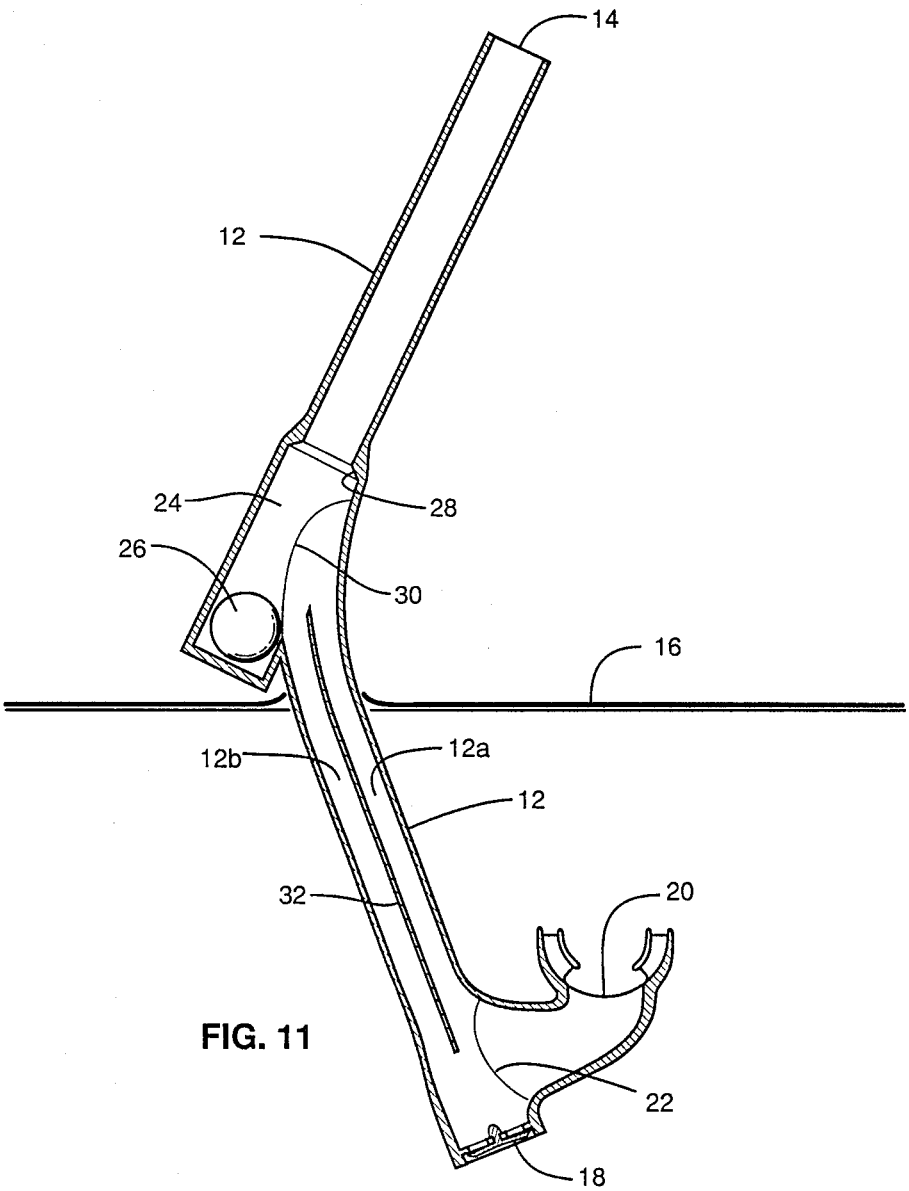
FIG. 11 is a longitudinal sectional view of yet another snorkel configuration which has been constructed in accordance with the principles of the present invention

Variations on the diameters, shape and radius of curvature of the conduits and chamber are contemplated as are deviations from circular cross sections. For example, the snorkel pictured in FIG. 11 has been constructed in accordance with the principles of the present invention, but the shapes of conduit 12 and chamber 24 are different from those of the preceding FIGS.

It is understood that those skilled in the art may conceive of modifications and/or changes to the invention described above. Any such modifications or changes which fall within the purview of the description are intended to be included therein as well. This description is intended to be illustrative and is not intended to be limitative. The scope of the invention is limited only by the scope of the claims appended hereto.

I claim:

1. A snorkel device comprising:

a conduit having first and second ends thereof;

said first end of said conduit being open whereby it is unobstructed and freely admits ambient fluid into said conduit;

mouthpiece means joined to said second end of said conduit and communicating fluid flow with said conduit;

a chamber intersecting said conduit intermediate said first and second ends of said conduit, said chamber intersection communicating fluid flow with said conduit;

a mobile member situated in said chamber, said mobile member substantially blocking outward fluid flow in said conduit when water is flooding said chamber; and purge valve means disposed below said chamber, said purge valve means arranged to selectively provide unidirectional flow from said conduit to ambient.

2. The snorkel device recited in claim 1 including:

second purge valve means disposed adjacent and above said chamber intersection with said conduit, said second purge valve means arranged to selectively provide unidirectional flow from said conduit to ambient.

3. The snorkel device recited in claim 1 including:

partition means dividing said conduit into two parallel channels, said channels intermediate said mouthpiece means and said chamber intersection with said conduit.

4. The snorkel recited in claim 1 wherein:

restraining means adjacent said chamber intersection with said conduit, said restraining means maintaining said mobile member within said chamber.

5. The snorkel device recited in claim 1 wherein:

said mobile member has a specific gravity which provides buoyancy in water.

6. The snorkel device recited in claim 1 wherein:

said mobile member is spherically shaped.

7. The snorkel device recited in claim 1 wherein:

said purge valve means includes flexible diaphragm means mounted to selectively open under pressure thereby to permit unidirectional flow from the interior of said conduit to ambient.

8. The snorkel device recited in claim 1 wherein:

said purge valve means has a fluid flow area at least equal to the fluid flow area of said conduit.

9. The snorkel device recited in claim 1 wherein:

said conduit defines a substantially smooth flow path between said first end of said conduit and said mouthpiece means.

10. The snorkel device recited in claim 1 wherein:

said chamber provides unobstructed fluid flow clearance past said mobile member when said chamber is not flooded with water.

11. The snorkel device recited in claim 1 wherein:

said chamber incorporates seat means adjacent said chamber intersection with said conduit, and said seat means forms a substantially flow blocking closure with said mobile member when said mobile member is resting against it.

12. The snorkel device recited in claim 11 wherein:

said seat means comprises a conical shelf formed around said chamber intersection with said conduit.

13. The snorkel device recited in claim 1 wherein:

said chamber is located approximately midway between said first and second ends of said conduit.

14. The snorkel device recited in claim 1 wherein:

said conduit has a substantially elliptical cross section.

15. The snorkel device recited in claim 1 including:

a second chamber intermediate said second end of said conduit and said purge valve means.

16. The snorkel device recited in claim 15 wherein:

said second chamber has an internal volume at least equivalent to ten percent (10%) of the total internal volume of said snorkel device.

17. A snorkel device comprising:

a first conduit adapted to extend above the water surface when said snorkel device is in use and supported by a diver swimming face down on the water surface, said first conduit having first and second ends thereof;

said first end of said first conduit being open whereby it is unobstructed and freely admits ambient fluid into said snorkel device;

a chamber having upper and side openings, and a closed bottom;

said second end of said first conduit joined to communicate fluid flow with said chamber via said upper opening of said chamber;

a second conduit adapted to extend below the water surface, and having first and second ends thereof;

said first end of said second conduit joined to communicate fluid flow with said chamber via said side opening of said chamber;

mouthpiece means joined to said second end of said second conduit and communicating fluid flow with said second conduit;

purge valve means arranged to selectively provide unidirectional flow from the interior of said second conduit to ambient; and a buoyant member moveably situated in said chamber intermediate said upper opening and said closed bottom, said buoyant member selectively buoyed toward said upper opening of said chamber thereby substantially blocking upward fluid flow through said upper opening into said first conduit when water is flooding said chamber.

* * * * *